US005221875A

United States Patent [19]

Odenthal

[11] Patent Number: 5,221,875

[45] Date of Patent: Jun. 22, 1993

[54] HIGH RESOLUTION CATHODE-RAY TUBE WITH HIGH BANDWIDTH CAPABILITY

[75] Inventor: Conrad J. Odenthal, Portland, Oreg.

[73] Assignee: Tektronix, Inc., Wilsonville, Oreg.

[21] Appl. No.: 881,584

[22] Filed: May 12, 1992

[51] Int. Cl.[5] ..... H01J 29/46; H01J 29/56

[52] U.S. Cl. ..... 315/14; 315/383; 313/447; 313/451

[58] Field of Search ..... 315/14, 15, 381, 383; 313/447, 444, 451

[56] References Cited

U.S. PATENT DOCUMENTS

| | | | |
|---|---|---|---|
| 4,500,809 | 2/1985 | Odenthal et al. | 313/444 |
| 4,651,064 | 3/1987 | Parker et al. | 315/383 |
| 4,973,890 | 11/1990 | Desjardins | 315/383 |
| 4,977,348 | 12/1990 | Odenthal | 313/479 |
| 5,028,838 | 7/1991 | Askew et al. | 313/456 |
| 5,077,498 | 12/1991 | Odenthal | 315/15 |

*Primary Examiner*—Theodore M. Blum

*Attorney, Agent, or Firm*—John D. Winkelman; Mark M. Meininger

[57] ABSTRACT

The present invention includes a cathode-ray tube (10) capable of providing a high-brightness, high-resolution large screen display that is compatible with, for example, field sequential liquid crystal color display systems and monochrome imaging systems. Preferably, the tube includes a small-diameter cathode assembly (14 of 110) with an adjacent small-diameter control grid electrode (38 or 114). The small diameters of the cathode assembly and the control grid electrode result in relatively little capacitance and are, therefore, compatible with relatively high video signal bandwidths. A thick accelerating electrode (66 or 150) is positioned adjacent the control grid electrode to prefocus the electron beam and, thereby, form it with relatively low spherical aberration. In a preferred embodiment, the electron beam is modulated in a push-pull manner by applying a video modulation signal and its inverse to the cathode and the control grid electrode.

13 Claims, 3 Drawing Sheets

HIGH RESOLUTION CATHODE-RAY TUBE WITH HIGH BANDWIDTH CAPABILITY

TECHNICAL FIELD

The present invention relates to electron discharge devices and, in particular, to an electron gun assembly that provides an electron discharge device with high resolution, high bandwidth display capability.

BACKGROUND OF THE INVENTION

High-brightness, high-resolution cathode-ray tubes are employed in a variety of applications including, for example, monochrome displays used in medical imaging and field-sequential liquid crystal color displays of the type described in U.S. Pat. No. 4,582,396 to Bos et al. These displays are desirable because they are capable of providing high-resolution images in accordance with the resolution of the cathode-ray tube. However, the cathode-ray tube must be capable of forming relatively bright images.

More specifically, field-sequential color displays typically employ a cathode-ray tube with a single electron gun that generates in sequence three color component images that are transmitted through a liquid crystal light shutter to form a full-color display. The liquid crystal light shutters through which the images are transmitted typically attenuate the brightness of the light generated by the cathode-ray tube by between about 93 percent and 95 percent. Similarly, high resolution monochrome displays typically include a high contrast notched or neutral density filter that attenuates the brightness of the light as much as 81 percent. The cathode-ray tube must, therefore, generate light of sufficient brightness to form an acceptable resulting high resolution image.

Many high resolution displays have relatively small display screens with diagonal dimensions of less than about 25.4 cm (10 inches). Such a display screen typically includes no more than about 0.3 million picture elements or pixels and requires a video signal bandwidth of about 30 MHz for monochrome displays and 85 MHz for field-sequential color displays. A video signal bandwidth of about 110 MHz is the maximum at which most cathode-ray tube electron guns can modulate an electron beam.

One limiting factor on the video signal bandwidth capability of most cathode-ray tubes is that the cathode and immediately adjacent control grid electrode that cooperate to modulate the electron beam each have a relatively high capacitance. An electron gun having a low capacitance cathode and a low capacitance control grid electrode is described in U.S. Pat. No. 4,500,809 of Odenthal et al.

This electron gun includes an accelerating grid electrode that is configured as the frustum of a cone and, therefore, has a tendency to magnify the spherical aberration of the electron beam. The effect of spherical aberration is particularly disadvantageous in high resolution displays because it enlarges the electron beam spot size characteristic, consequently interfering with the high resolution performance of the cathode-ray tube. An electron gun of this type has inadequate performance characteristics for high-resolution, high-brightness display images.

U.S. Pat. No. 5,077,498 of Odenthal describes a cathode-ray tube with a flat, relatively thick accelerating grid electrode that cooperates with a high capacitance cap-shaped control grid electrode to provide an electron beam with reduced spherical aberration. The accelerating grid electrode is referred to as thick because its thickness is approximately equal to the diameter of the aperture in the electrode. Although an electron gun of this type is adequate for some high-brightness, high-resolution display applications, the high capacitance characteristics of the control grid electrode limit the video signal bandwidth capability of the electron gun. As a consequence, this electron gun is incapable of providing very high resolution, high-brightness display images on a large display screen.

SUMMARY OF THE INVENTION

An object of the present invention is, therefore, to provide a high-brightness, high-resolution cathode-ray tube.

Another object of this invention is to provide such a tube that is capable of operating at video signal bandwidths compatible with large-screen displays.

A further object of this invention is to provide such a tube that is compatible with field-sequential liquid crystal color displays and monochrome imaging systems.

The present invention includes a cathode-ray tube capable of providing a high-brightness, high-resolution large screen display that is compatible with field sequential liquid crystal color display systems and monochrome imaging systems. Preferably, the tube includes a small-diameter cathode assembly with an adjacent small-diameter control grid electrode. The small diameters of the cathode assembly and the control grid electrode provide them with low capacitance characteristics and are, therefore, compatible with relatively high video signal bandwidths. A thick accelerating grid electrode with a strong electric field superimposed on it is positioned adjacent the control grid electrode to prefocus the electron beam and demagnify the spherical aberration effect. The accelerating grid electrode is referred to as thick because its thickness is nominally the same as the diameter of the aperture in the accelerating grid electrode.

In a first preferred embodiment, the electron beam generated by the cathode assembly and the control grid electrode is modulated in a push-pull manner. Specifically, a video modulation signal and its inverse are applied to the control grid electrode and the cathode, respectively. Increasing and decreasing voltages in the video modulation signal cooperate with respective decreasing and increasing voltages in the inverse signal to modulate the electron beam.

Push-pull operation reduces by about one-half the video modulation signal magnitude required to modulate the electron beam. The reduced video modulation signal magnitudes together with the low capacitance characteristics of the electron gun allow electron beam modulation at extremely high frequency bandwidths of about 1.2 GHz. This capability for extremely high frequency modulation allows the manufacture of a high resolution field sequential liquid crystal color display having relatively large display screens with diagonal dimensions of about 58 cm (23 inches) corresponding to approximately 5 million pixels.

In a second preferred embodiment, the electron beam is modulated by applying a substantially fixed potential to the cathode assembly and a video modulation signal to the control grid electrode. Most conventional cathode-ray tubes modulate an electron beam by applying a fixed potential to the control grid electrode and a video modulation signal to the cathode assembly. Although the conventional manner of modulating an electron beam is generally acceptable, high frequency cathode drive circuitry typically generates electrical noise that would create noticeable artifacts in the display image of a high-resolution, high-brightness display. Applying a video modulation signal to the control grid electrode using high frequency grid drive circuitry reduces noise and thereby provides an improved high-resolution high-brightness display.

Additional objects and advantages of the present invention will be apparent from the detailed description of preferred embodiments thereof, which proceeds with reference to the accompanying drawings.

DETAILED DESCRIPTION OF PREFERRED EMBODIMENTS

Figure 1:
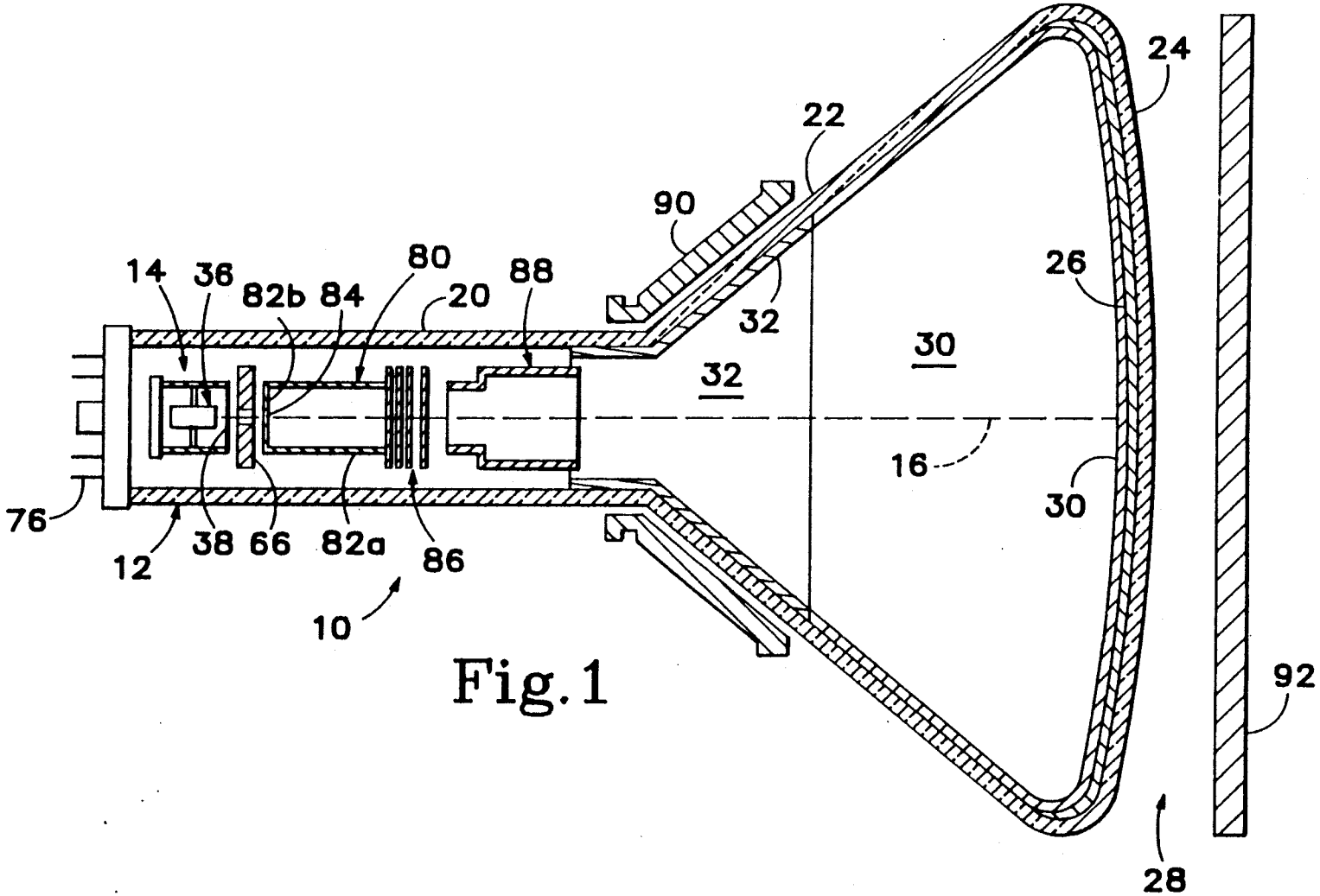
FIG. 1 is a side elevation sectional view of a cathode-ray tube display apparatus incorporating the present invention.
Figure 2:
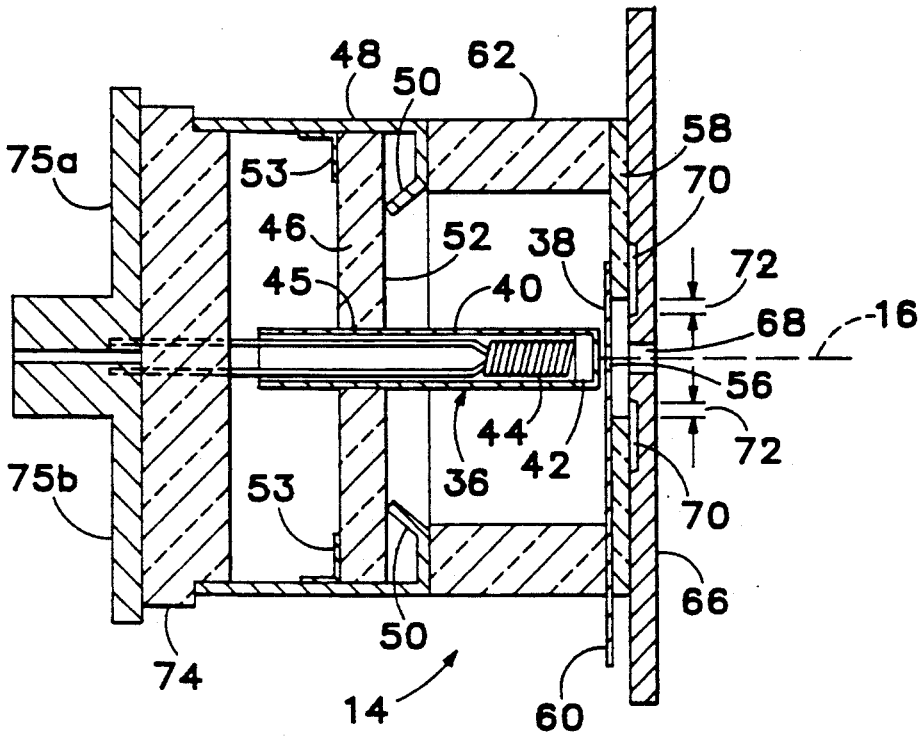
FIG. 2 is an enlarged side elevation sectional view of a triode section of an electron gun employed in the tube of FIG. 1.

With reference to FIGS. 1 and 2, a high-brightness, high-resolution cathode-ray tube 10 includes an evacuated envelope 12 that contains an electron gun 14 which forms and directs an electron beam generally along a beam axis 16 in tube 10. Envelope 12 includes a tubular glass neck 20, a glass funnel 22, and an optically transparent glass faceplate 24. A layer 26 of P-45 type phosphor material is deposited on the inner surface of faceplate 24 to form the display screen 28 of cathode-ray tube 10. An electron-transparent aluminum film 30 is deposited by evaporation on the inner surface of funnel 22 and phosphor layer 26, and a portion of the inner surface of envelope 12 is coated with an electrically resistive DAG layer 32.

Electron gun 14 is positioned in glass neck 20 at the end of tube 10 opposite display screen 28. Gun 14 includes a low capacitance cathode assembly 36 and an adjacent low capacitance control grid electrode (sometimes referred to as a G1) 38. Cathode assembly 36 includes a small-diameter cathode sleeve 40 with a cathode cap 42 mounted on sleeve 40 at its end adjacent control grid electrode 38. A heating element 44 is positioned inside sleeve 40 and an electron-emissive coating (not shown) impregnated into the front surface of cathode cap 42 includes, for example, a mixture of strontium, barium, and calcium carbonates.

Cathode sleeve 40 is press fit into an aperture 45 of a disk-shaped non-conductive cathode support member 46, which fits within a tubular support element 48 with multiple resilient fingers 50 (only two shown). A front surface 52 of cathode support member 46 engages resilient fingers 50 to position cathode cap 42 in spaced-apart relation to control grid electrode 38. Support member 46 is held against resilient fingers 50 by a cathode retainer ring 53 welded to the interior of tubular support element 48.

Figure 3:
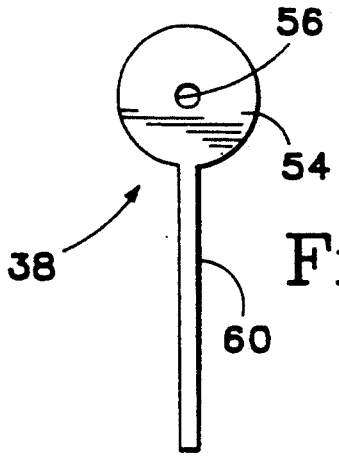
FIG. 3 is a front view of a control grid electrode employed in the electron gun of FIG. 2.

With reference to FIGS. 2 and 3, control grid electrode 38 includes a thin plate section 54 that has an aperture 56 and is brazed to a nonconductive, disk-shaped spacing element 58. Control grid electrode 38 includes a stem portion 60 that is integral with plate portion 54 and extends beyond spacing element 58 so that control grid 38 can be electrically connected to a control grid drive source (not shown). A tubular spacing element 62 is brazed to and extends between tubular support member 48 and spacing element 58.

A thick, substantially flat accelerating grid electrode (sometimes referred to as a G2) 66 is brazed to spacing element 58 on its face opposite the face to which control grid electrode 38 is mounted. Accelerating grid electrode 66 includes an aperture 68 and an inner annular recess 70 positioned symmetrically about beam axis 16. Accelerating grid electrode 66 is referred to as thick because it has a thickness 71*a* (FIG. 5) that is nominally the same as the diameter 71*b* (FIG. 5) of aperture 68, as described below in greater detail.

Figure 5:
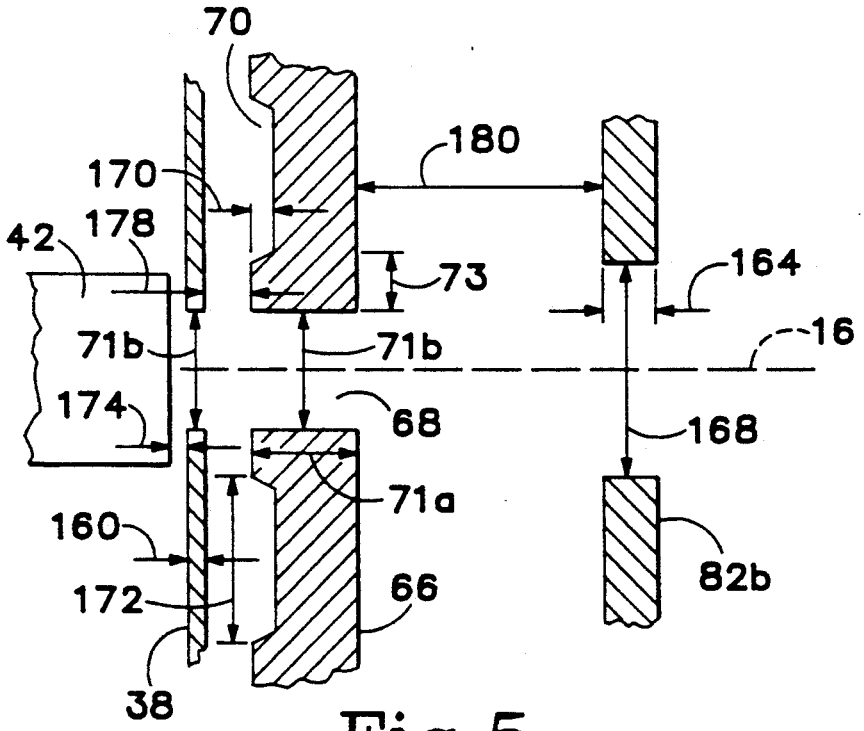
FIG. 5 is an enlarged fragmentary side elevation view of elements in the triode section of the electron gun of FIG. 2.

Recess 70 functions to reduce the capacitance between control grid electrode 38 and accelerating grid electrode 66 by providing a region 72 of increased separation between control grid electrode 38 and accelerating grid electrode 66. In addition, recess 70 prevents brazing material that secures accelerating grid electrode 66 to spacing element 58 from inadvertently passing to control grid electrode 38 and forming a short circuit between them. Preferably, recess 70 is machined into accelerating grid electrode 66 to be separated from aperture 68 by a distance 73 (FIG. 5). Alternatively, recess 70 may be formed by stamping or machining accelerating grid electrode 66 across aperture 68 and then welding one or more flat washers (not shown) to electrode 66 to increase its thickness at aperture 68.

Tubular support element 48 receives a nonconductive tab support 74 that supports a pair of heater tabs 75*a* and 75*b* to which heating element 44 is connected. Voltages are applied to cathode assembly 14, control grid electrode 38, and accelerating grid electrode 66 via a set of base pins 76 (FIG. 1), that extend through envelope 12, and connecting wires (not shown). A heating current is similarly applied to heating element 44 via heater tabs 75*a* and 75*b*.

In a preferred manner of operating electron gun 14, control grid electrode 38 receives a high frequency video modulation signal of between about 0 and +17.5 volts and cathode assembly 36 receives an inverse high frequency video modulation signal of between about 0 and −17.5 volts. The video modulation signal and the inverse video modulation signal may have bandwidths of about 1.2 GHz and cooperate to modulate the electron beam in a push-pull manner.

More specifically, maximum and minimum modulation of the electron beam intensity is provided by respective maximum and minimum voltage differences between the video modulation signal and its inverse. Increases and decreases in the voltage of the video modulation signal occur concurrently with respective decreases and increases in the voltage of the inverse video modulation signal. As a result, the video modulation signal and its inverse undergo voltage changes of opposite polarity that cooperate to enhance the electron beam modulation in a push-pull manner.

Accelerating grid electrode 66 receives a potential of between +75 and +250 volts, preferably about 100 volts, relative to the maximum voltage applied to control grid electrode 38 (i.e., about +17.5 volts). A potential of about 100 volts applied to accelerating grid electrode 66 establishes for electron gun 14 a cathode cut-off voltage $V_{CO}$ of as low as about 35 volts. The opposing 17.5 volt variations in the video modulation signal and its inverse cooperate to provide up to about a 35 volt variation that varies the electron beam intensity between maximum and minimum values.

The video modulation signal and its inverse are of sufficiently low magnitude (i.e., approximately 17.5 volt variations) that high resolution field sequential liquid crystal color display systems can include large display screens (e.g., 58 cm diagonal dimensions). Such display systems include up to about 5 million pixels and require very high video signal frequencies of up to about 1.2 GHz. Present video drive circuitry is generally incapable of generating video signals at such high frequencies because video modulation signal variations required by conventional electron guns are about 60 volts. In contrast, the low voltage magnitude performance of electron gun 14 provided by push-pull operation allows the electron beam modulation to reach frequencies of up to 1.2 GHz.

Referring to FIG. 1, cathode-ray tube 10 further includes a tubular element 80 with a cylindrical portion 82*a* and a flat end disk plate 82*b* (sometimes referred to as a G3) that has an aperture 84 positioned adjacent aperture 68 of accelerating grid electrode 66. Tubular element 80 receives a high-voltage potential of between 3.5 and 7.0 kilovolts, preferably about 5 kilovolts, to form a high potential field at disk plate 82*b* that cooperates with thick accelerating grid electrode 66 to strongly prefocus the electron beam and demagnify the spherical aberration effect.

A set of astigmatism correction plates 86 and a wide-diameter tubular focus lens 88 function to, respectively, correct astigmatism in the electron beam and focus it toward display screen 28, which receives a potential of 18 to 30 kilovolts. A high efficiency deflection yoke 90 positioned along cathode-ray tube 10 in alignment with electrically resistive DAG layer 32 deflects the electron beam across a display screen in a raster scan pattern. A display plate assembly 92 is positioned in front of display screen 28 of cathode-ray tube 10 and includes, for example, a high contrast neutral density or notched filter or a liquid crystal light shutter to provide a monochrome medical imaging system or a field sequential color display system, respectively.

The low capacitance characteristics of cathode assembly 36 and control grid electrode 38, the low cathode cut-off voltage ($V_{co}$) provided by accelerating grid electrode 66, and the push-pull modulation of the electron beam allow cathode-ray tube 10 to modulate the electron beam at frequencies of up to about 1.2 GHz. In addition, the low spherical aberration provided by cooperation between tubular element 80 and accelerating grid electrode 66 allows high resolution, high brightness images to be formed on display screen 28. Cathode-ray tube 10 is, therefore, capable of providing high brightness, very high resolution displays on relatively large display screens.

Figure 4:
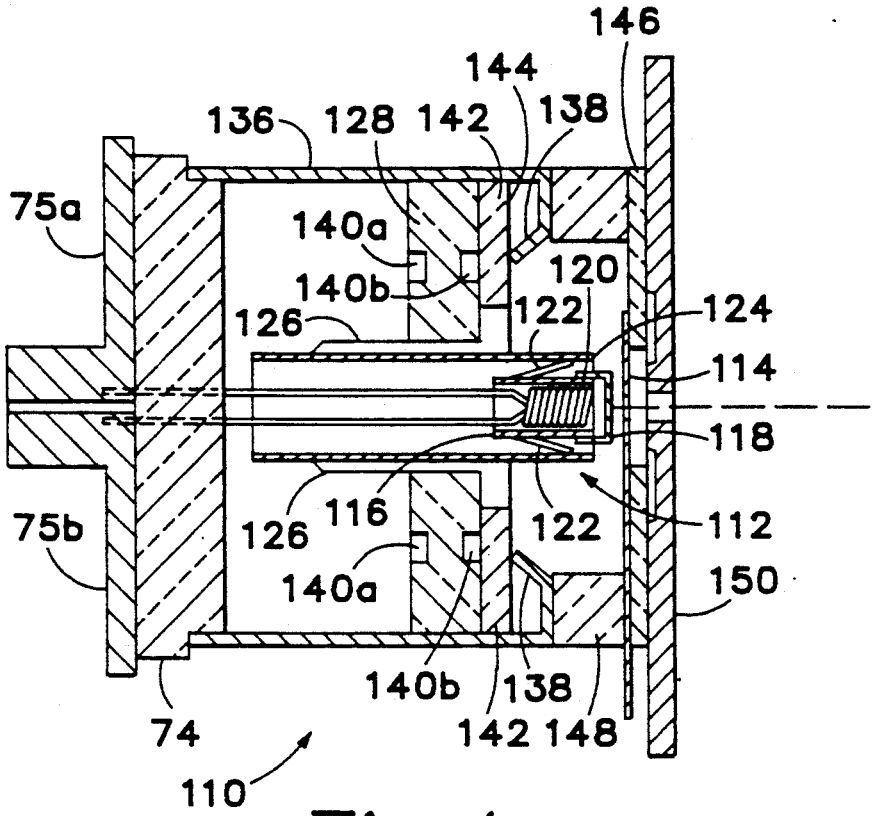
FIG. 4 is an enlarged side elevation sectional view of a triode section of an alternative electron gun that can be employed in the tube of FIG. 1.

FIG. 4 is a sectional side elevation view of an alternative electron gun 110 that includes a low capacitance cathode assembly 112 and an adjacent low capacitance control grid electrode (sometimes referred to as a G1) 114 that is substantially similar to control grid electrode 38 of electron gun 14 (FIG. 2). Cathode assembly 112 includes a short, small-diameter cathode sleeve 116 with a cathode cap 118 mounted on sleeve 116 at its end adjacent control grid electrode 114. A heating element 120 is positioned inside sleeve 116 and an electron-emissive coating (not shown) impregnated into the front surface of cathode cap 118 includes, for example, a mixture of strontium, barium, and calcium carbonates.

Cathode sleeve 116 is held by three inner resilient fingers 122 (only two shown) positioned inside a tubular support element 124 having a cylindrical slip fit 126 positioned to engage an annular non-conductive cathode support member 128. Cathode assembly 112, tubular support element 124, and annular support member 128 are preferably components of a low capacitance CPD TM cathode assembly manufactured by Semicon Corporation of Lexington, Kentucky.

Annular support member 128 fits within a tubular support element 136 with multiple resilient fingers 138 (only two shown). Annular support member 128 provided by the manufacturer includes a pair of opposed annular recesses 140*a* and 140*b*, the latter of which could incorrectly engage resilient fingers 138 and cause misalignment of cathode assembly 112. To prevent such misalignment, a substantially flat, nonconductive ring 142 is positioned adjacent annular support member 128 to provide a flat surface 144 for engaging resilient fingers 138, thereby to accurately position cathode cap 118 in spaced-apart relation to control grid electrode 114. Support member 128 and ring 142 are held against resilient fingers 138 by a cathode retaining ring 145 welded to the interior of tubular support element 136.

Control grid electrode 114 is brazed to a nonconductive, disk-shaped spacing element 146. A tubular spacing element 148 is brazed to and extends between tubular support member 136 and spacing element 146. A thick accelerating grid electrode (sometimes referred to as a G2) 150 is brazed to spacing element 148 on its face opposite the face to which control grid electrode 114 is mounted. Accelerating grid electrode 150 is substantially similar to accelerating grid electrode 66 of electron gun 14 (FIG. 2).

Cathode assembly 112 is desireable because it has a comparatively long operating life and provides for high cathode loading. The structure of cathode assembly accommodates its relatively high operating temperature, but provides it with a capacitance greater than that of cathode assembly 14. In a preferred manner of operating electron gun 110, cathode assembly 112 receives a substantially constant voltage of about 0 volts and control grid electrode 114 receives a video modulation signal of between about 0 and 35 volts. The video modulation signal may have frequencies of up to about 350 MHz and cooperates with the substantially constant voltage applied to cathode assembly 112 to provide low noise modulation of the electron beam.

More specifically, conventional electron gun operation would include applying a constant voltage to control grid electrode 114 and applying the video modulation signal to cathode assembly 112. However, heating element 120 of cathode assembly 112 introduces relatively large amounts of capacitance, which reduces bandwidth capability and limits the resolution of a display device. Moreover, the preferred operation of electron gun 110 substantially eliminates the noise introduced by conventional operation of cathode drive circuitry, thereby making electron gun 110 compatible with high resolution display applications.

FIG. 5 shows the dimensions of various elements in electron gun 14. Control grid electrode 38 has a thickness 160 of about 0.075 mm (0.003 inch), accelerating grid electrode 66 has a thickness 71*a* of about 0.50 mm (0.02–0.025 inch), and disk plate 82*b* has a thickness 164 of about 0.17 mm (0.007 inch). Aperture 56 of control grid electrode 38 and aperture 68 of accelerating grid electrode 66 have diameters 71*b* of about 0.56 mm (0.022 inch) and aperture 84 of disk plate 82*b* has a diameter 168 of about 1 mm (0.04 inch). Annular recess 70 in accelerating grid electrode 66 is separated from aperture 68 by a distance 73 of about 0.6 mm (0.024 inch) and has a depth 170 of about 0.075 mm (0.003 inch) and a width 172 of about 1.62 mm (0.065 inch).

Control grid electrode 38 is spaced apart from cathode cap 42 by a distance 174 of about 0.1 mm (0.004 inch). Accelerating grid electrode 66 is spaced apart from control grid electrode 38 by a distance 178 of about 0.23 mm (0.009 inch). Disk plate 82*b* is spaced apart from accelerating grid electrode 66 by a distance 180 of about 0.63 mm (0.025 inch).

Control grid electrode 38 and accelerating grid electrode 66 are preferably formed of Kovar (a registered tradename) alloy manufactured by several steel companies. Cathode support member 46, spacing element 58, tubular spacing element 62, and base plate 74 are preferably formed of alumina. Cathode sleeve 40 and tubular support element 48 are preferably formed of nichrome, and cathode cap 42 is preferably formed of nickel.

It will be obvious to those having skill in the art that many changes may be made in the above-described details of the preferred embodiment of the present invention without departing from the underlying principles thereof. For example, electron gun 110 could be operated in the push-pull manner described with reference to electron gun 14 and electron gun 14 could be operated in the manner described with reference to electron gun 110. The scope of the invention should, therefore, be determined only by the following claims.

I claim:

1. An electron gun assembly for an electron discharge device, comprising:

a low capacitance cathode assembly including a small-diameter cathode sleeve extending through a nonconductive, disk-shaped cathode support member and a cathode cap mounted on an end of the cathode sleeve;

a thin, disk-shaped control grid electrode spaced apart from the cathode cap by a non-conductive tubular spacing element that supports a disk-shaped spacing element with a first major face to which the control grid electrode is mounted; and an accelerating grid electrode configured as a substantially flat, thick disk and positioned adjacent the control grid electrode.

2. The electron gun assembly of claim 1 in which the accelerating grid electrode includes a major surface facing the control grid electrode and an annular recess in the major surface.

3. The electron gun assembly of claim 1 in which the accelerating grid electrode includes a major surface that faces the control grid electrode and is mounted to the disk-shaped spacing element on a second major face opposite the first major.

4. An electron gun for an electron discharge device, comprising:

a low capacitance cathode assembly for receiving a cathode drive signal;

a thin, disk-shaped first grid electrode positioned adjacent the cathode assembly for receiving a modulation signal, the modulation signal on the first grid electrode cooperating with the cathode drive signal on the cathode assembly to form a modulated electron beam; and a second grid electrode configured as a substantially flat, thick disk and positioned adjacent the first grid electrode for receiving a substantially constant potential for prefocusing the electron beam.

5. The electron gun of claim 4 in which the second grid electrode includes a major surface facing the first grid electrode and an annular recess in the major surface.

6. The electron gun of claim 4 in which the cathode drive signal is of a substantially constant voltage.

7. The electron gun of claim 6 in which the modulation signal includes a frequency up to about 350 MHz.

8. The electron gun of claim 4 in which the cathode drive signal is modulated as an inverse of the modulation signal.

9. The electron gun of claim 8 in which the modulation signal includes a frequency up to about 1.2 GHz.

10. The electron gun of claim 4 in which the modulation signal includes a frequency greater than 110 MHz.

11. In an electron discharge tube having a low capacitance grid electrode positioned between a low capacitance cathode assembly and an accelerating electrode for forming an electron beam with an intensity, a method of modulating the intensity of the electron beam, comprising:

applying to the accelerating electrode a potential that establishes a cathode cut-off voltage of twice a predetermined value in which a voltage of the predetermined value is modulatable at a frequency of 1.2 GHz;

applying to the low capacitance cathode assembly a first electron beam modulation component signal with a voltage range of the predetermined value and a frequency of up to 1.2 GHz; and applying a second electron beam modulation component signal to the low capacitance grid electrode, the first and second electron beam modulation component signals being inverses of each other and cooperating to provide push-pull modulation of the electron beam.

12. The method of claim 11 in which the voltage of predetermined value is less than about 20 volts.

13. The method of claim 11 in which the accelerating electrode is configured as a substantially flat, thick disk.

* * * * *